US007541753B2

(12) United States Patent
Florian et al.

(10) Patent No.: US 7,541,753 B2
(45) Date of Patent: Jun. 2, 2009

(54) STARTER FOR LOW-PRESSURE DISCHARGE LAMPS

(75) Inventors: Stefano Florian, Treviso (IT); Axel Girstenbreu, Bobingen (DE)

(73) Assignee: Osram Gesellschaft Mit Beschraenkter Haftung, Munich (DE)

( * ) Notice: Subject to any disclaimer, the term of this patent is extended or adjusted under 35 U.S.C. 154(b) by 0 days.

(21) Appl. No.: 11/885,169

(22) PCT Filed: Feb. 6, 2006

(86) PCT No.: PCT/DE2006/000184

§ 371 (c)(1),
(2), (4) Date: Aug. 28, 2007

(87) PCT Pub. No.: WO2006/089506

PCT Pub. Date: Aug. 31, 2006

(65) Prior Publication Data

US 2008/0129228 A1 Jun. 5, 2008

(30) Foreign Application Priority Data

Feb. 28, 2005 (DE) ..... 10 2005 009 057

(51) Int. Cl.
*H05B 41/00* (2006.01)

(52) U.S. Cl. ..... 315/362; 315/100; 315/209 R

(58) Field of Classification Search ..... 315/362, 315/112–118, 326, 94, 100
See application file for complete search history.

(56) References Cited

FOREIGN PATENT DOCUMENTS

| | | |
|---|---|---|
| DE | 23 21 212 | 11/1974 |
| DE | 24 52 417 | 5/1976 |
| DE | 91 04 136 | 6/1991 |
| FR | 2 100 135 | 3/1972 |

*Primary Examiner*—Douglas W Owens
*Assistant Examiner*—Jianzi Chen

(57) ABSTRACT

Disclosed is a starter for AC-fed low-pressure discharge lamps that are operated on a series inductor. The starter comprises a glow fuse, a high-temperature conductor (NTC resistor) that is serially connected to the glow fuse, and a resetting bimetal switch which is serially connected to the glow fuse and the high-temperature conductor and is in thermal contact therewith. The high-temperature conductor is provided with high resistance in a cold state, which is transformed into low resistance by elements of built-up heat while the bimetal switch interrupts the electrode heating circuit when the low-pressure discharge lamp fails to ignite. According to the invention, the current is conducted via the high-temperature conductor for both igniting the low-pressure discharge lamp and switching off when the discharge lamp fails to ignite.

16 Claims, 1 Drawing Sheet

STARTER FOR LOW-PRESSURE DISCHARGE LAMPS

TECHNICAL FIELD

The invention relates to a starter for AC fed low pressure discharge lamps in accordance with the preamble of patent claim 1.

PRIOR ART

Such a starter is disclosed, for example, in DE 91 04 136 U1. Said starter essentially comprises a glow igniter and a switch off device that switches off the starter after a number of unsuccessful attempts to ignite the fluorescent lamp. To this end, the switch off device has an NTC thermistor, an ohmic resistance connected in parallel and a resettable bimetallic switch that is arranged in series with the parallel circuit of NTC thermistor and ohmic resistance. The bimetallic switch is in thermal contact with the NTC thermistor and the ohmic resistance, and serves the purpose of switching off the starter for safety in the event of a defective glow igniter or defective fluorescent lamp. The resistance value of the ohmic resistance is substantially smaller than the resistance value of the NTC thermistor, and so the NTC thermistor, which is of high resistance during startup is short circuited by the ohmic resistance at the beginning of the starting phase, and electrodes of the fluorescent lamp are preheated. After a number of unsuccessful attempts at igniting the fluorescent lamp, the ohmic resistance and the NTC thermistor heat up, the conductivity of the latter increases substantially.

The heat produced is transferred via a mounting plate or by direct heat emission to the bimetallic switch, which opens under the influence of heat and interrupts the electrical heating circuit (safety switch off).

It is disadvantageous for these types of starter that upon malfunction of the starter, for example failure of the starter to switch off, overheating of the ohmic resistance can occur, and it is thereby possible for the starter cannister to melt and for the starter to be destroyed. It is necessary for this reason to provide the ohmic resistance with an additional protective covering, for example made from silicone cement, which reduces the heat emission thereof, and thus prevents the starter housing from melting. However, such protective coverings are associated with an increased outlay on production.

SUMMARY OF THE INVENTION

It is the object of the invention to provide a starter for AC fed low pressure discharge lamps, in the case of which, by contrast with conventional solutions, it is rendered possible to ignite the fluorescent lamp quickly and switch it off reliably, and overheating is prevented in conjunction with reduced outlay on production.

This object is achieved according to the invention by means of the features of claim 1. Particularly advantageous embodiments of the invention are described in the dependent claims.

The inventive starter for AC fed low pressure discharge lamps operated on a series inductor comprises a glow igniter, an NTC thermistor that is connected in series with the glow igniter, and a resettable bimetallic switch that is connected in series with the glow igniter and the NTC thermistor and is in thermal contact therewith, the NTC thermistor having in the cold state a high ohmic resistance that is transformed into a low ohmic resistance by intrinsic heating, and the bimetallic switch interrupts the electrode heating circuit upon nonignition of the low pressure discharge lamp. According to the invention, the current is conducted via the NTC thermistor both for igniting the low pressure discharge lamp and for switching off upon nonignition. Said NTC thermistor is designed such that at the beginning of the starting operation it has a high ohmic resistance that leads to rapid heating. This delivers a faster transition of the NTC thermistor into a low ohmic resistance range, and thus delivers a high switch on current for the low pressure discharge lamp. This enables the lamp to be ignited quickly, thus pleasing the customer. By contrast with the prior art, according to the invention there is no need for an additional ohmic resistance, the result of which is to prevent overheating of the starter and to reduce the outlay on production substantially.

In accordance with a preferred exemplary embodiment, at a temperature of 25° C. the resistance of the NTC thermistor lies in a range from approximately 400 to 650 O, that is to say substantially higher than in the prior art. This high ohmic resistance leads to a fast intrinsic heating of the NTC thermistor, a rapid transition into a low ohmic resistance range, and thus to a high switch on current required for a switch on time satisfactory to the customer.

At a temperature of 100° C. the resistance of the NTC thermistor lies in a range from approximately 30 to 50 O.

At 25° C. and at 100° C. the electrical resistance values preferably have a ratio of R1/R2>10.

The mean starting time of the starter lies preferably in a range from approximately 1.3 to 6.0 s. This ensures the low pressure discharge lamp is operated without an inconvenient delay in switching on, which satisfies the customer.

In a preferred exemplary embodiment, the mean switch off time of the starter is more than approximately 20 s and less than approximately 70 s. It has proved to be particularly advantageous to arrange the NTC thermistor in the immediate vicinity of an electrode of the bimetallic switch.

The electrode of the bimetallic switch, and the NTC thermistor are preferably connected to a mounting plate in an electrically and thermally conducting fashion. The good transfer of heat between the NTC thermistor and the bimetallic switch enables reliable switching off in the event of nonignition of the low pressure discharge lamp.

In a preferred embodiment of the invention, the electronic components of the starter are arranged in a starter canister made from an insulating plastic of the fire protection class V0. An improved fire protection behavior of the starter canister is thereby ensured in the event of a fault, and the formation of burning drops, for example, is prevented.

BRIEF DESCRIPTION OF THE DRAWINGS

The invention is explained below in more detail with the aid of a preferred exemplary embodiment. In the drawing.

PREFERRED EMBODIMENTS OF THE INVENTION

Figure 1:
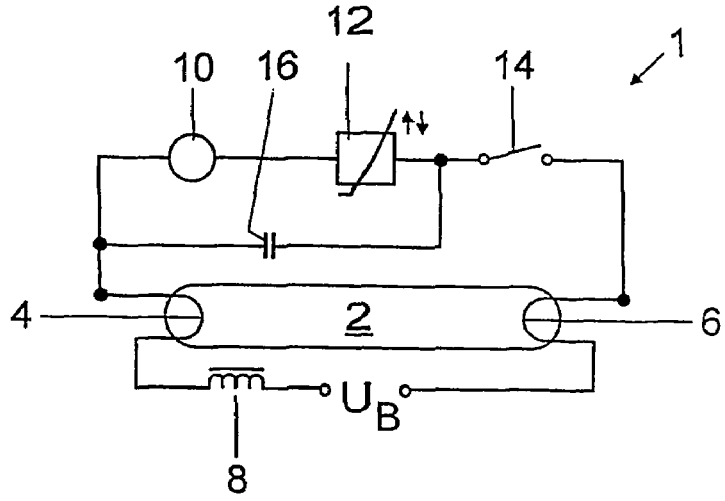
FIG. 1 shows a schematic circuit arrangement of an inventive starter.

FIG. 1 shows a schematic circuit arrangement of an inventive safety rapid starter (ST 171 DEOS) 1 for operating a fluorescent lamp 2, in the case of which the electrode filaments 4, 6 of the fluorescent lamp 2 are supplied with AC voltage $U_B$ via a series inductor 8. The series inductor 8 serves to limit the current and is connected in series with the fluorescent lamp 2. The starter 1 essentially comprises a glow igniter 10 for starting the fluorescent lamp 2, and a switch off device that in accordance with the invention has an NTC thermistor 12, that is to say a temperature dependent resistor with a negative temperature coefficient, and is arranged in series with a bimetallic switch 14. The latter is closed when the starter 1 is switched on, and serves to switch off the heating circuit for safety purposes. A capacitor 16 is connected in parallel with the glow igniter 10 and the NTC thermistor 12 in order to suppress radio interference in the starter 1.

Figure 2:
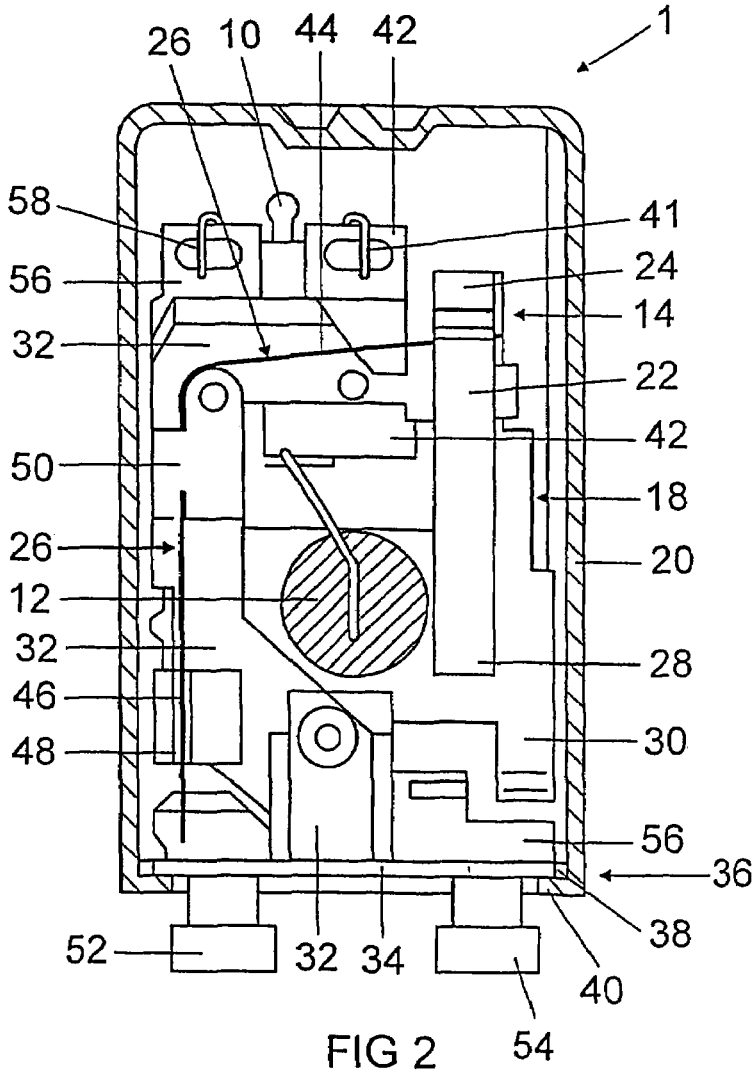
FIG. 2 shows a plan view of the starter from FIG. 1.

In accordance with FIG. 2, which shows a spatial arrangement of the starter components, the latter are fastened on a base plate 18 that is inserted at right angles into an approximately cylindrical starter canister 20. The bimetallic switch 14 comprising a bimetallic electrode 22 with an offset end section 24 and a spring wire electrode 26 that is latched tight from behind into the offset end section 24. The bimetallic electrode 22 is welded by a second end section 28, which is not offset, to a metallic mounting plate 30 that is supported by a plastic frame 32. The plastic frame 32 merges at the bottom into an approximately round bottom plate 34 that is inserted into an annular groove 38 formed on an end section 36 of the starter canister 20, and is fixed axially via an annular projection 40. The NTC thermistor 12 is fixed in an electrically conducting fashion on the mounting plate 30, and has an electrically conducting connection to a metallic contact element 42 on which a first electrode terminal 41 of the glow igniter 10, which is covered in FIG. 2 for the most part by the mounting plate 30 and the plastic frame 32, is soldered. The spring wire electrode 26 has a limb 44, arranged approximately horizontally in FIG. 2, and a vertical limb 46, the vertical limb 46 being supported in a groove 48 of the plastic frame 32, being fixed thereon via a fuse part 50, and being connected in an electrically conducting fashion to a first contact pin 52 of the starter 1. The horizontal limb 44 of the spring wire electrode 26 is latched tight into the offset end section 24 of the bimetallic electrode 22 such that the spring wire electrode 26 makes the electrical contact between the offset end section 24 of the bimetallic electrode 22 and via the vertical limb 46 to the first contact pin 52 of the starter. A second contact pin 54 is connected in an electrically conducting fashion to a second electrode terminal 58 of the glow igniter 10 via a further contact element 56.

In FIG. 2, the plastic frame 32 and the mounting plate 30 cover the radio interference capacitor 16, whose terminals are connected in an electrically conducting fashion to the second contact pin 54 and the mounting plate 30, as well as a switch button that rests movably on the horizontal limb 44 of the spring wire electrode 26 and via which the spring wire electrode 26 that has become unlatched can be latched tight again into the offset end section 24 of the bimetallic electrode 22.

The function of the starter 1 is explained by way of example below with reference to FIGS. 1 and 2. After the fluorescent lamp 2 has been switched on, the NTC thermistor 12 goes over into a low ohmic resistance range in a very short time by intrinsic heating on the basis of its resistance, a high ohmic one in the cold state of approximately 560 O. This makes available the maximum preheating current required for preheating the electrode filaments 4, 6 of the fluorescent lamp 2, and so the electrode filaments 4, 6 are preheated to 800 to 1000° C. within a very short time. After the preheating temperature has been reached, the electric current in the heating circuit is interrupted by means of the glow igniter 10. To this end, the glow igniter 10 is designed as a glow lamp with two bimetallic electrodes (not illustrated) that bend in relation to one another under the thermal influence of the glow light, and finally touch. When the bimetallic electrodes touch, the glow light is extinguished and its thermal effect is eliminated. After the cooling of the electrodes, the latter reopen and interrupt the circuit. This current interruption produces in the series inductor 8 as a consequence of the inductance thereof the voltage pulse required for ignition which initiates the discharge in the fluorescent lamp 2.

If, because of a fault, the fluorescent lamp 2 does not ignite, and if the starter 1 has unsuccessfully undertaken attempts at ignition over a defined time period, the temperature of the NTC thermistor 12 thus rises further, the heat produced being transferred to the bimetallic electrode 22 of the bimetallic switch 14 via the mounting plate 30 and by heat emission. The bimetallic electrode 22 bends under the thermal effect of the NTC thermistor 12, and the offset end section 24 and clears the horizontal limb 44 of the biased spring wire electrode 26 and thereby opens the electrical contact. The electrical heating circuit is thereby interrupted, and the starter 1 is in the state of safety switch off. After the fault has been cleared, for example by replacing the fluorescent lamp 2 at the end of its service life, the spring wire electrode 26 can be latched tight again behind the offset end section 24 of the bimetallic electrode 22 by actuating the switch button (not illustrated).

The starter 1 embodied in accordance with the invention ensures the lamp starts quickly and therefore satisfactorily for the customer, and reliably switches off the preheating circuit in the case of a fault. Since, however, in contrast with the prior art, no use is made of an ohmic resistance, overheating, and therefore melting of the starter canister 20 is prevented, as is the destruction of the starter 1. Furthermore, the design of the starter 1 is considerably simplified.

What is disclosed is a starter 1 for AC fed low pressure discharge lamps 2 operated in a series inductor 8, having a glow igniter 10, an NTC thermistor 12 that is connected in series with the glow igniter 10, and a resettable bimetallic switch 14 that is connected in series with the glow igniter 10 and the NTC thermistor 12 and is in thermal contact therewith, the NTC thermistor 12 having in the cold state a high ohmic resistance that is transformed into a low ohmic resistance by intrinsic heating, and the bimetallic switch 14 interrupts the electrode heating circuit upon nonignition of the low pressure discharge lamp. According to the invention, the current is conducted via the NTC thermistor 12 both for igniting the low pressure discharge lamp 2 and for switching off upon nonignition.

The invention claimed is:

1. A starter for AC fed low pressure discharge lamps operated on a series inductor, having a glow igniter, an NTC thermistor that is connected in series with the glow igniter, and a resettable bimetallic switch that is connected in series with the glow igniter and the NTC thermistor and is in thermal contact therewith, the NTC thermistor having in a cold state a high ohmic resistance that is transformed into a low ohmic resistance by intrinsic heating, and the bimetallic switch interrupts the electrode heating circuit upon nonignition of the low pressure discharge lamp, characterized in that the current is conducted via the NTC thermistor both for igniting the low pressure discharge lamp and for switching off upon nonignition.

2. The starter as claimed in claim 1, in which at a temperature of 25° C. the resistance of the NTC thermistor lies in a range from approximately 400 to 650 Ω.

3. The starter as claimed in claim 1, in which at a temperature of 100° C. the resistance of the NTC thermistor lies in a range from approximately 30 to 50 Ω.

4. The starter as claimed in claim 1, in which at 25° C. and at 100° C. the electrical resistance values have a ratio of R1/R2>10.

5. The starter as claimed in claim 1, in which the mean starting time of the starter lies in a range from approximately 1.3 to 6.0 s.

6. The starter as claimed in claim 1, in which the mean switch off time of the starter is more than approximately 20 s and less than approximately 70 s.

7. The starter as claimed in claim 1, in which the NTC thermistor is arranged in the immediate vicinity of an electrode of the bimetallic switch.

8. The starter as claimed in claim 1, in which the electronic components of the starter are arranged in a starter canister made from an insulating plastic.

9. The starter as claimed in claim 1, in which the resettable bimetallic switch is in thermal contact solely with the NTC thermistor.

10. The starter as claimed in claim 2, in which at a temperature of 100° C. the resistance of the NTC thermistor lies in a range from approximately 30 to 50 Ω.

11. The starter as claimed in claim 2, in which at 25° C. and at 100° C. the electrical resistance values have a ratio of R1/R2>10.

12. The starter as claimed in claim 2, in which the mean starting time of the starter lies in a range from approximately 1.3 to 6.0 s.

13. The starter as claimed in claim 2, in which the mean switch off time of the starter is more than approximately 20 s and less than approximately 70 s.

14. The starter as claimed in claim 2, in which the NTC thermistor is arranged in the immediate vicinity of an electrode of the bimetallic switch.

15. The starter as claimed in claim 2, in which the electronic components of the starter are arranged in a starter canister made from an insulating plastic.

16. The starter as claimed in claim 7, in which the electrode and the NTC thermistor are connected to a mounting plate in an electrically and thermally conducting fashion.

* * * * *